United States Patent [19]

Dirico

[11] Patent Number: 4,574,561

[45] Date of Patent: Mar. 11, 1986

[54] APPARATUS AND METHOD FOR SEALING THE COVER SIDE FLAPS OF CARTONS

[75] Inventor: Mark A. Dirico, Marshfield, Mass.

[73] Assignee: Hub Folding Box Co., Inc., Mansfield, Mass.

[21] Appl. No.: 696,653

[22] Filed: Jan. 31, 1985

Related U.S. Application Data

[63] Continuation of Ser. No. 374,069, May 3, 1982, abandoned.

[51] Int. Cl.[4] ..... B65B 7/26; B65B 51/02

[52] U.S. Cl. ..... 53/376; 53/383; 53/387; 118/244; 118/DIG. 3; 493/132; 493/150; 493/475

[58] Field of Search ..... 53/376, 383, 387, 491; 493/132, 150, 475, 478, 479; 198/841; 118/239, 244, DIG. 3

[56] References Cited

U.S. PATENT DOCUMENTS

| | | | |
|---|---|---|---|
| 2,097,428 | 11/1937 | Bergstein | 118/DIG. 3 |
| 2,737,002 | 3/1956 | Demler | 53/383 X |
| 2,764,123 | 9/1956 | Derderian | 118/DIG. 3 |
| 3,267,637 | 8/1966 | Baker | 53/376 X |
| 3,523,398 | 8/1970 | Barnes | 53/491 |
| 4,222,483 | 9/1980 | Wootton | 198/841 X |

*Primary Examiner*—John Sipos

*Attorney, Agent, or Firm*—Pearson & Pearson

[57] ABSTRACT

The horizontally extending cover side flaps of a plurality of identical filled closed cartons, are glued, down folded, pressed and set by continuously advancing the cartons individually and successively, in untimed relation, between upper and lower carrier belts and along a path through an adhesive applying zone, a flap folding zone and a compression zone. The upper carrier belts are mounted on a sub-frame structure as are the gently curved down fold bars and are raised and lowered relative to the main frame for runs of different height cartons. The glue pots are independently movable vertically and laterally. The compression rolls are resiliently and yieldably mounted to individually and successively press and set the hot melt adhesive without undue pressure which might retard the untimed advance of the cartons.

1 Claim, 12 Drawing Figures

*Fig.2.*
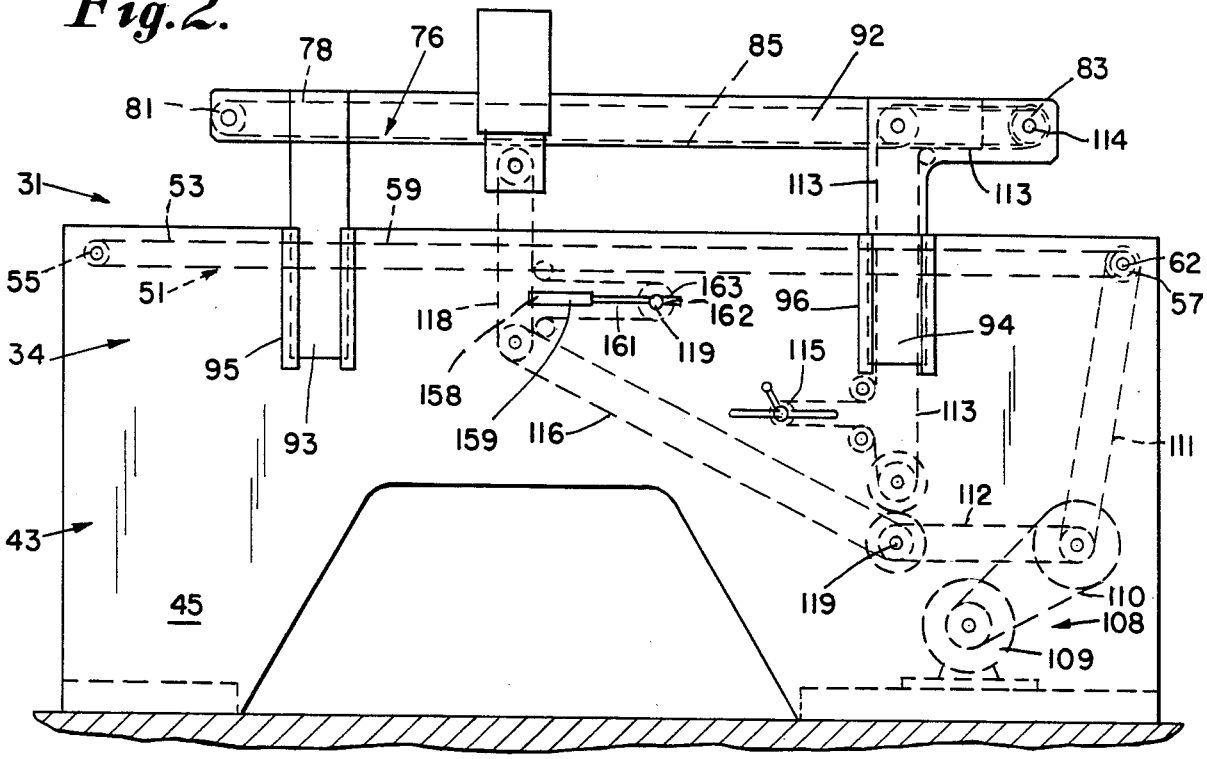
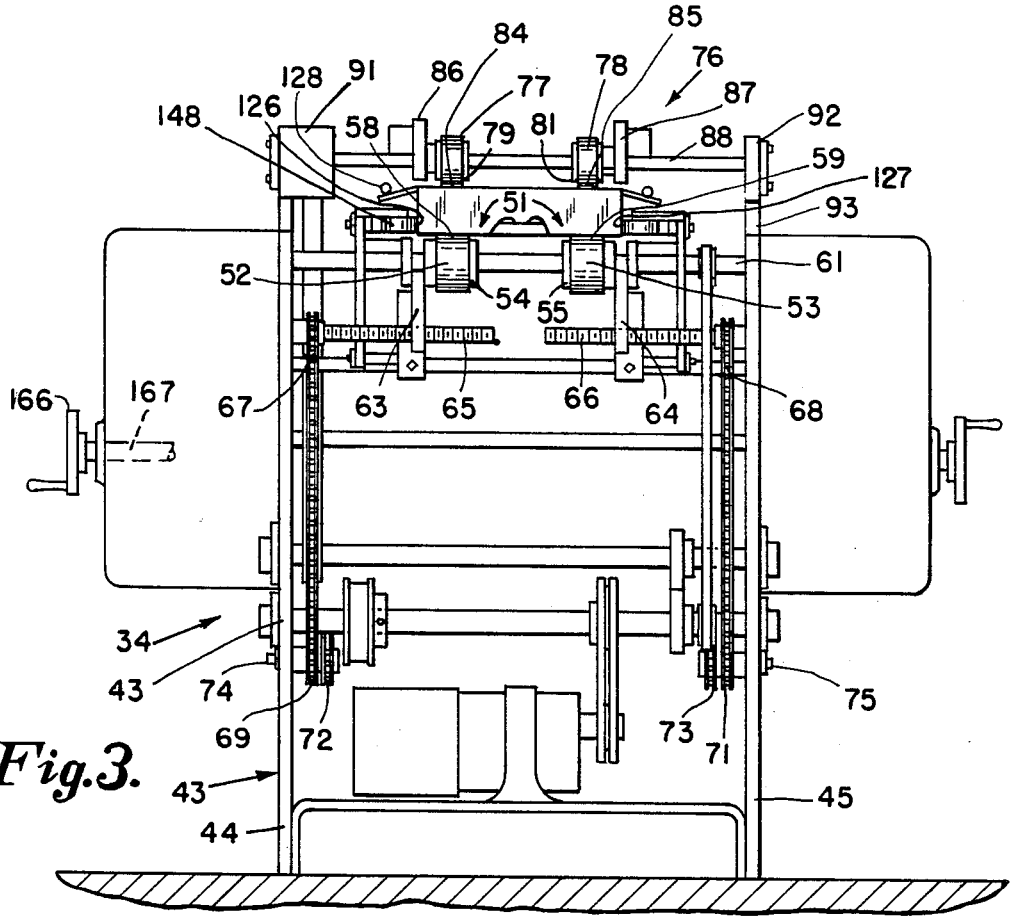
*Fig.3.*

Fig.4.
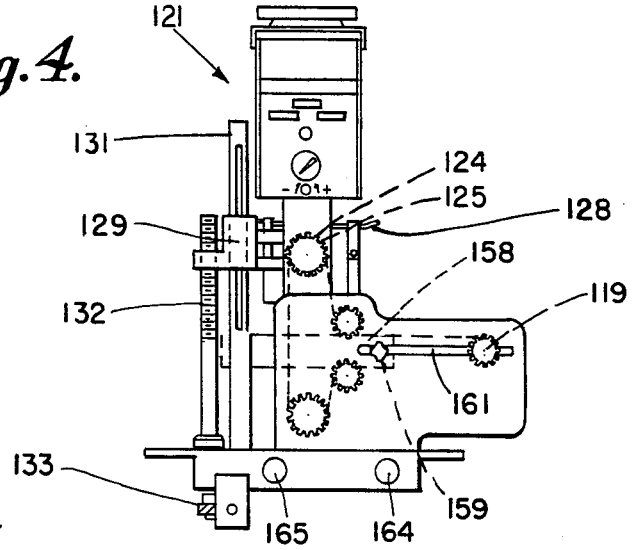
Fig.5.
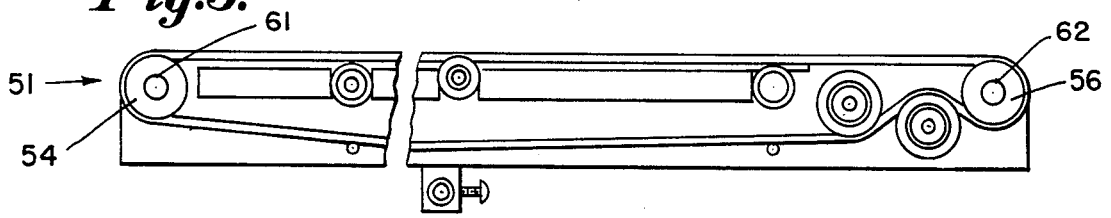
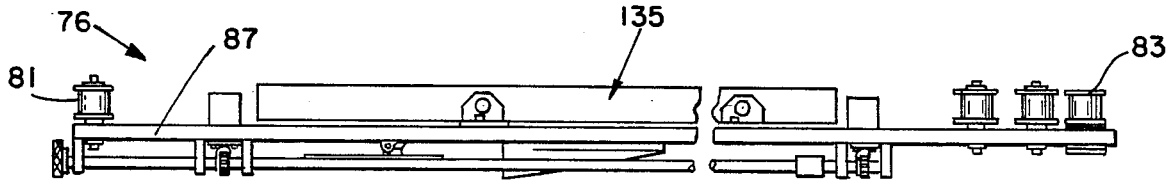
Fig.6.
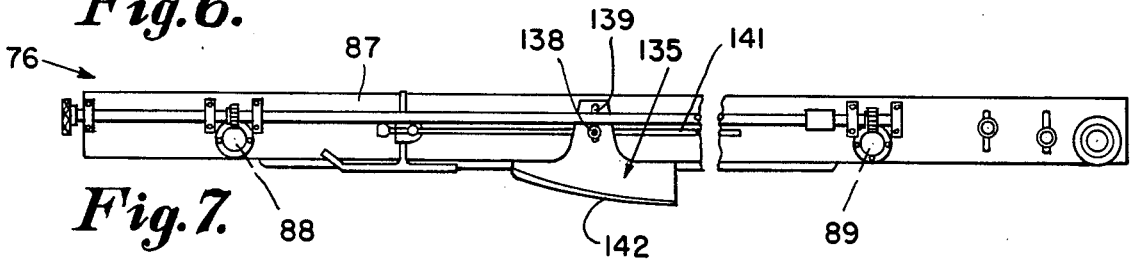
Fig.7.
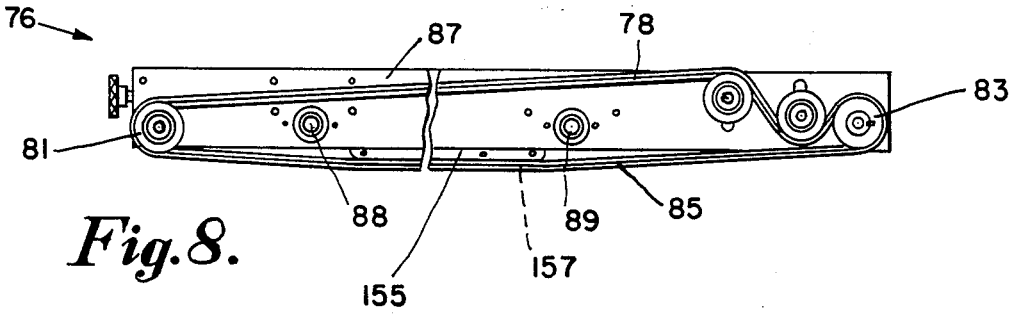
Fig.8.

APPARATUS AND METHOD FOR SEALING THE COVER SIDE FLAPS OF CARTONS

This is a continuation of my application Ser. No. 374,069, filed May 3, 1982, now abandoned.

BACKGROUND OF THE INVENTION

This invention relates to an apparatus and method for sealing the sidewise extending cover side flaps of a plurality of cartons which have been filled and which have had the cover closed and a front flap locked usually by means of a tongue, or spear, fitting in a slit in the front wall of the carton.

The following patents are believed to relate to the invention.

| | | |
|---|---|---|
| U.S. Pat. No. 2,974,460 | Walther | July 11, 1961 |
| U.S. Pat. No. 2,991,610 | Adacusky | July 11, 1961 |
| U.S. Pat. No. 3,267,637 | Baker | Aug. 23, 1966 |
| U.S. Pat. No. 3,307,329 | LeFief | March 7, 1967 |
| U.S. Pat. No. 3,523,398 | Barnes | Aug. 11, 1970 |
| U.S. Pat. No. 3,740,919 | Heisler | June 26, 1973 |
| U.S. Pat. No. 4,203,355 | Meyers | May 20, 1980 |

Most of the prior art patents have attempted to solve the sealing of such flaps by advancing the filled, closed, cartons on timed, lower, registration chains having upstanding registration lugs which push the back of the carton and may damage the contents when the carton meets the resistance of fold bars, compression bars, or the like, during advance. Such push marks, or distortion of the carton is commercially unacceptable especially where the contents are food stuffs such as quick frozen fish.

Typical of the solutions of the above patents is that disclosed in Baker U.S. Pat. No. 3,267,637 wherein the cartons are advanced by registration lugs, front panel trailing while passing by adhesive application rolls, then under fold bars and then through compression rolls (Col. 4, lines 34–38).

In Barnes, U.S. Pat. No. 3,523,398, the end flaps of cartons are sealed by turning the carton through an angle of 90°, so that the cover flaps are on one side, whereupon the flaps are plowed open, adhesive applied, flaps closed and compression applied by plates. Barnes provides upper and lower untimed carrier belts but makes no provision for raising and lowering the height of the upper carriers, adhesive applicators and fold bars to accommodate cartons of various heights.

The prior art has not taught the use of untimed, upper and lower conveyor belts, resiliently yieldable compression rolls or an upper combined conveyor and hold down belt sub-frame structure which carries gently curved flap fold down bars, and is vertically movable relative to the lower conveyor belts.

SUMMARY OF THIS INVENTION

In this invention the high speed of upper and lower, untimed, conveyor, or carrier belts is achieved in addition to the size adjustment for runs of different dimensioned cartons by means of spreading the carrier belts apart and raising and lowering the upper belts relative to the lower belts. Damage to the closed, filled cartons, and their contents, is avoided by the use of friction contact with the top and bottom only, the use of fold bars which contact the edges of the cover side flaps with a gentle curve and urge them smoothly to closed position and by the use of resilient, yieldably-mounted compression rolls which press without unduly retarding the advance of the cartons.

BRIEF DESCRIPTION OF THE DRAWINGS

FIG. 2 is a diagrammatic view similar to FIG. 1 showing the drive trains;

FIG. 3 is an end elevation of the apparatus shown in FIGS. 1 and 2 from the entrance end;

FIG. 4 is a diagrammatic, detail, side elevation of the glue pot mechanism;

FIG. 5 is a detail, side elevation of the lower belt carrier assembly;

FIG. 6 is a plan view;

FIG. 7 is a side elevation;

FIG. 8 is a side view showing the upper belt carrier assembly;

DESCRIPTION OF A PREFERRED EMBODIMENT

Figure 12:
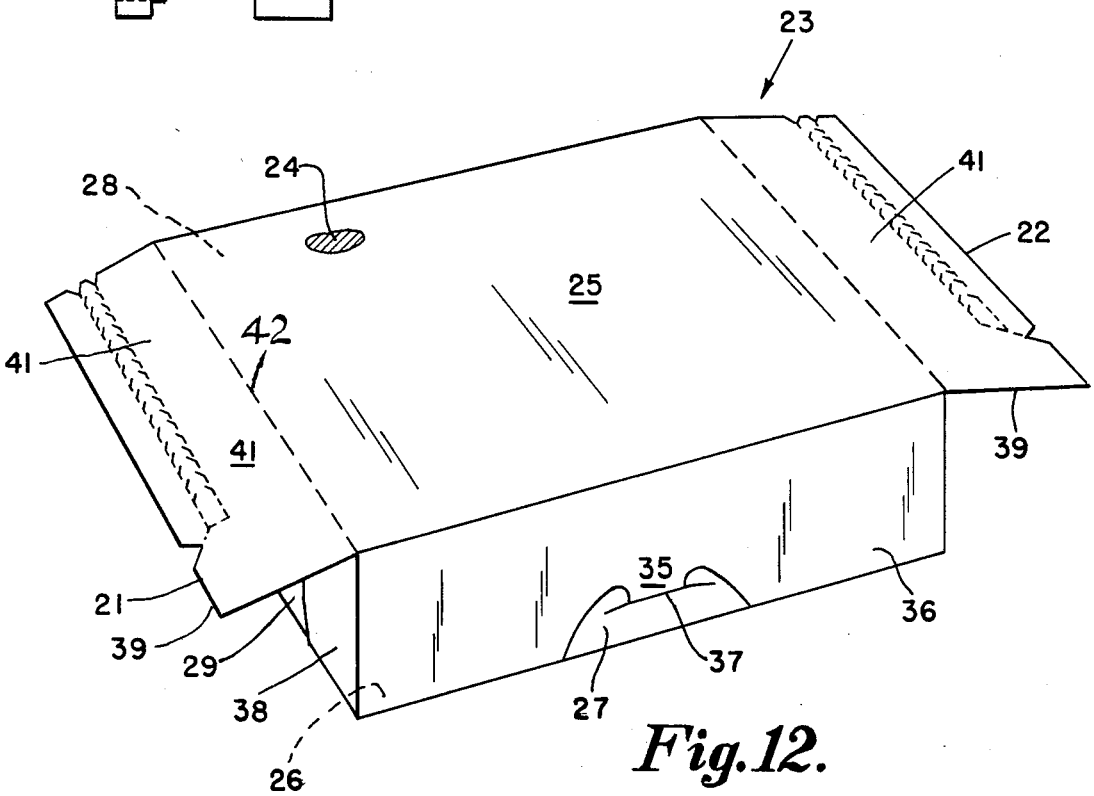
FIG. 12 is a perspective view of a closed, filled carton ready to enter the apparatus of the invention.

As shown in FIG. 12, the apparatus and method of the invention is intended for the purpose of high, speed, untimed, accurate sealing of the horizontal, sidewise extending cover side flaps 21 and 22 of each erected, closed filled carton 23 which may contain frozen foodstuffs 24. Each carton 23 includes a cover panel 25, a bottom panel 26, a front panel 27, rear panel 28, and opposite side panels such as 29. When introduced into the entrance end 31 of the carton feed zone 32 of the apparatus 34 of the invention, each carton is in the condition shown with the tongue, or spear, 35 of the front cover flap 36 inserted in the tongue slit 37 in the front panel 27 and with the cover side flaps 21 and 22 extending substantially horizontally. The side tabs of flap 36, such as at 38, are adhered to the side panels such as 29 as shown.

The under face of each sidewise extending cover flap is designated 39, the upper faces thereof are designated 41 and the hinge fold lines thereof are designated 42.

The apparatus 34 includes a main frame 43, formed of a pair of side frame pieces 44 and 45, the elongated frame being divided into a carton feed zone 32, an adhesive application zone 46, a side flap downfold zone 47, a compression roll zone 48 and a carton discharge zone 49.

Untimed, lower carrier belt means 51, is provided in the form of a pair of carrier belts 52 and 53 in side-by-side relationship, each trained around a sheave 54 or 55, at the entrance end 31 and each trained around a sheave 56 or 57 in the discharge zone 49, so that the upper stretches 58 and 59 extend in a horizontal path from zone 32, through zones 46, 47, and 48 to zone 49.

Sheaves 54 and 55 are laterally slidable on a shaft 61, and sheaves 56 and 57 are laterally slidable on a shaft 62, the shafts 61 and 62 extending between the opposite side frame pieces. Each sheave is movable laterally in opposite directions by a bracket 63 or 64, threaded on rods such as 65 or 66, the rods having sprockets such as 67 or 68, connected by chains 69 or 71 to a sprocket 72 or 73, turnable by a sprocket shaft 74 or 75. Thus, the lower sheaves move outward laterally or inward laterally to adjust the spacing therebetween, as the shafts 74 and 75 are turned, to accommodate runs of cartons of various widths.

Untimed upper belt carrier means 76 includes a pair of upper carrier, or hold down belts, 77 and 78 each trained around one of a pair of sheaves 79 or 81 at the entrance end 31 and each trained around one of a pair of sheaves 82 or 83 in the discharge zone of apparatus 34. The lower stretch 84 or 85 of each upper belt is spaced above the upper stretch of each lower belt to receive and frictionally advance the closed, filled cartons 23 along a horizontal path through the apparatus. The sheaves 79, 81, 82 and 83 are each mounted on brackets such as 86 or 87 laterally slidable on shafts such as 88 or 89 extending between the side frame pieces 44 and 45 so that they can be manually moved to the desired location.

Untimed, upper belt carrier means 76, includes a pair of sub-frame pieces 91 and 92 each having depending members such as 93 and 94 vertically slidable in socket, or way members 95 or 96 fixed to one of the side frame pieces 44 or 45 of main frame 43. Each depending member 93 and 94, on each opposite side of the apparatus includes a threaded bracket 97 or 98 for a threaded rod 99 or 101, each rod 99 or 101 having a spur gear 102 or 103 fast to the bottom thereof and meshed with a corresponding spur gear 104 or 105 on an elongated rod 106, rotatably mounted on one of the side frame pieces. Thus, as the rods 104 on each side are turned by handles 107, the entrance and discharge ends of the sub-frame pieces 91 and 92 rise, or fall, equally and simultaneously, to adjust for cartons runs of different height cartons.

Power means 108, for driving the upper and lower carrier belts includes an electric motor 109, connected by a power train 110 (FIG. 2), in turn connected by a power train 111 to the shaft 62, which drives the sheaves 56 and 57 of the lower belts. Power means 108 also includes a power train 112 connecting power train 110 to a sub-drive train 113 which leads to the shaft 114 of the sheaves 82 and 83 of the upper carrier belts, therebeing a slidable, adjustable idler element 115 to enable the sub-frame structures 91 and 92 to be raised and lowered while still driving the sheaves and belts. Another power train 116 leads from the shaft 119 to the glue pot drive train 118, therebeing an adjustable, idler element 119 therein to permit the glue pots to rise and lower with the sub-frame structures 91 and 92.

Adhesive applicator means 121 is provided in the adhesive application zone 46, in the form of a pair of glue pots 122 and 123 each mounted on one of the side frame pieces 44 or 45 and each having an adhesive applicator roll 124 or 125 with an upper face 126 or 127 aligned to engage the under faces 39 of each successive carton 23 advancing along the path through the zone and apply a band of adhesive thereto.

Preferably flap hold down bars such as 128 are provided on each glue pot to engage the upper faces 41 of the flaps during roll application of adhesive.

Each glue pot 122 or 123 is vertically movable and adjustable by means of brackets 129 slidable on posts such as 131 and movable thereon by threaded rod 132 to the desired height. Rod 132 is turned by a worm gear mechanism 133 and handle, or wheel 134. The glue pots 122 and 123 are of the hot melt type for roll applying a hot melt adhesive.

Fold down means 135 is in the form of a pair of cover side flap fold down bars 136 and 137 each mounted by a bolt such as 138 in a vertical slot 139 in the bar and the bolt tightenable in a horizontal slot 141 in one of the sub-frame pieces 91 or 92 so that the gently curved, helical underface 142 of each bar will engage and smoothly downfold one of the cover side flaps against the side wall panels of each successive carton 23 as the cartons are advanced through zone 47, and without undue resistance to the advance of the carton.

A pair of elongated side guide bars such as at 143 preferably run the full length of the apparatus 34, to keep the cartons aligned, therebeing a flared opening 144 at the entrance end and a pair of squaring up rollers such as at 145 along the path.

Figure 11:
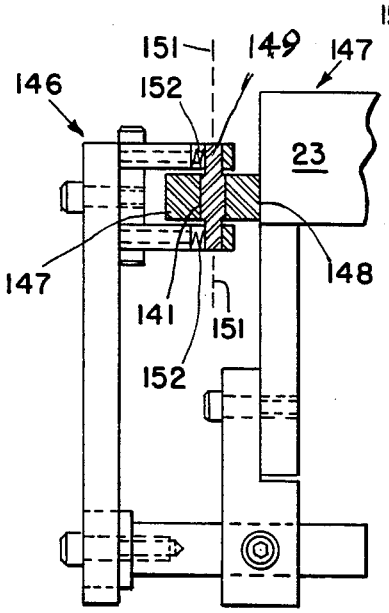
FIG. 11 is a fragmentary, detail view in half section of one of the resiliently mounted compression rolls.

Compression roll means 146 is provided in the form of a pair of spaced apart parallel rows 147 of compression rolls such as 148 each extending for about four feet on an opposite side of the compression zone 48. Each compression roll 148 is rotatable on a vertical shaft 149 having a laterally movable axis 151 normally spring pressed by spring 152 inwardly to resiliently and yieldably press against the downfolded, hot melt adhesive sealed cover side flaps until the adhesive sets as the cartons advance along the path (FIG. 11).

Figure 1:
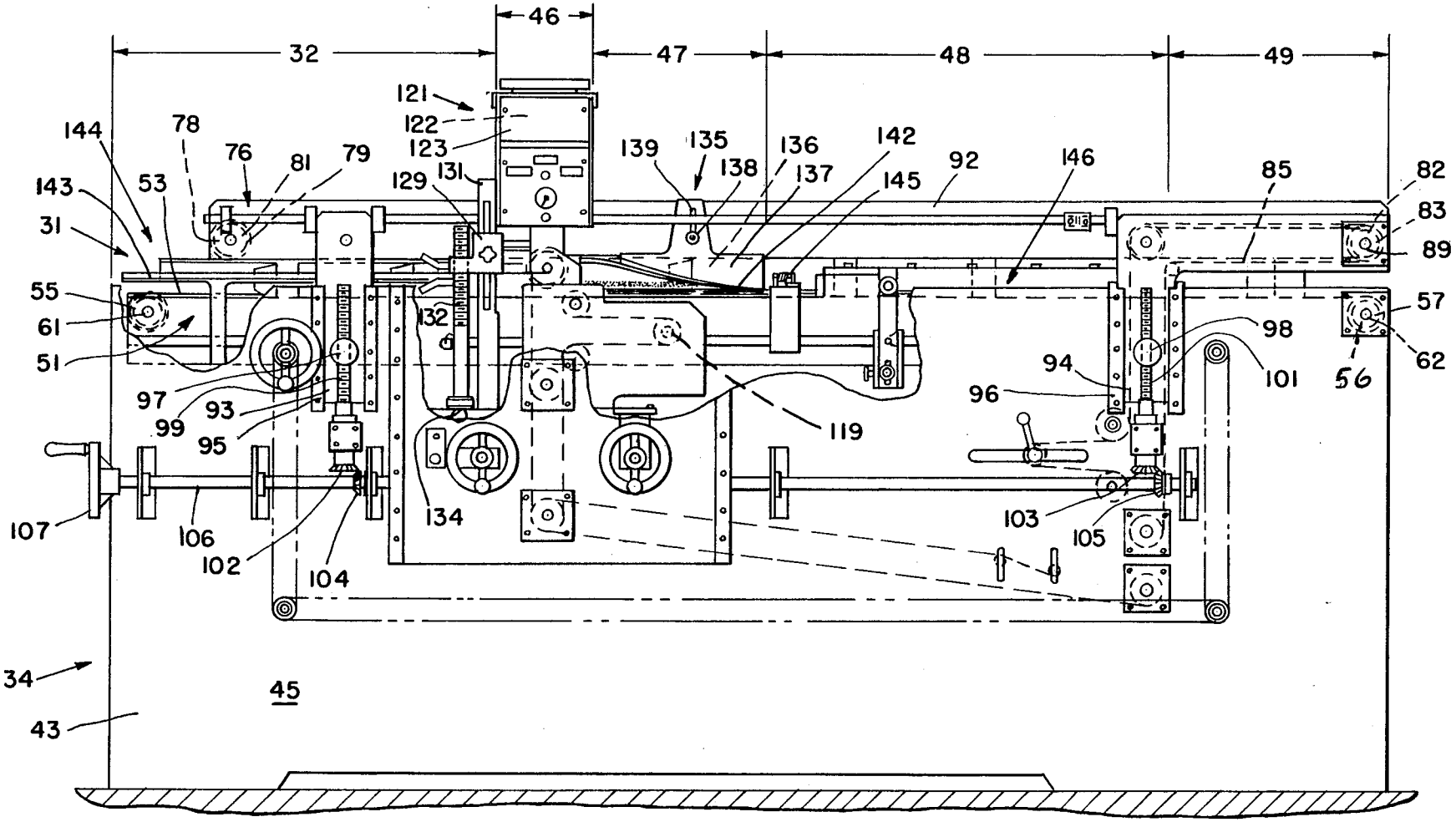
FIG. 1 is a side elevation of the apparatus of the invention with parts broken away.
Figure 9:
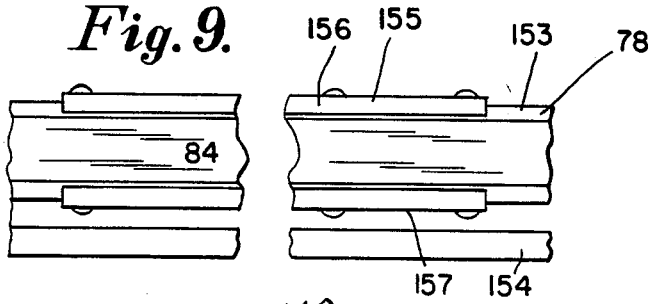
FIG. 9 is a fragmentary, detail plan view of the anti-sag plates.
Figure 10:
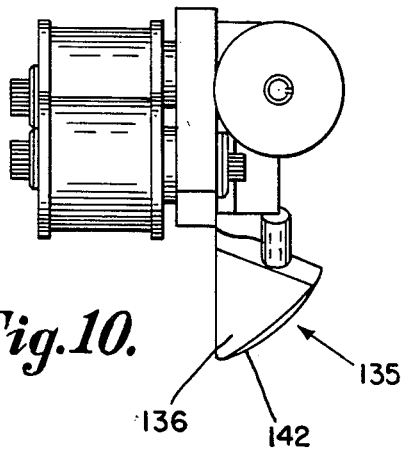
FIG. 10 is an end elevation of line 10-10 of FIG. 6.

As shown in FIGS. 5, 8, and 9, to avoid sag in the lower stretches 84 and 85 of the upper, untimed, carrier belts 77 and 78, the opposite edges 153 and 154 of each belt are cut away and a pair of elongated bars such as 155 are provided having inturned lower edges 156 and 157 in which the edges of the belt travel to support the same in desired areas along the path.

A spring box 158 is provided with a coil spring 159 and rod 161, the rod 161 spring urging idler element 119 outwardly to avoid sag and take up slack in glue pot drive train 118 as the glue pots are raised and lowered. A knob 162 is tightenable in slot 163 to affix the idler element in a desired position.

The glue pots are laterally movable on a pair of tie bars 164 and 165, extending between the side frame pieces 44 and 45, each by a separate handwheel 166, threaded rod 167, and a suitable threaded bracket.

I claim:

1. Apparatus for downfolding, adhering and pressing the side-wise extending cover flaps of a plurality of erected, filled cartons, having their cover panel and cover front flap closed, said apparatus having a main frame and comprising:

a pair of untimed, lower carrier belts extending along a horizontal path through said apparatus, said path including a carton feed zone, a side flap adhesive zone, a side flap downfold zone, a downfolded flap compression zone and a carton discharge zone;

a pair of untimed upper carrier belts extending along said path through said zones, at a spaced distance above, and in parallelism with, said untimed lower carrier belts, said upper and lower belts being spaced apart a predetermined distance to receive therebetween said cartons in vertical orientation with the bottoms thereof supported on said lower belts, their cover panels underlying said upper belts and their cover flaps extending horizontally side-wise from their cover panels;

a pair of glue pots each having a driven applicator roll and each mounted on an opposite side of said side flap adhesive zone, along said path, each said roll being positioned to apply a band of adhesive to the underface of one of said cover side flaps as said cartons pass through said zone;

a pair of elongated flap hold down bars each engaging the upper face of one of said side flaps during roll application of adhesive to the under face thereof;

a sub-frame mounted for vertical movement relative to said main frame to accommodate cartons of various heights, said sub-frame supporting said untimed upper carrier belts;

means for mounting said glue pots for independent movement laterally and vertically relative to said main frame and sub-frame;

mechanism for moving said sub-frame, vertically and mechanism for moving said glue pots laterally and vertically;

power means, to drive said apparatus including means to operably connect said power means to said upper and lower pairs of carrier belts to drive said belt and continuously advance said cartons through said zones in untimed, spaced relation, individually and successively along said path, front panel leading, means to operably connect said power means to the glue rolls of said glue pots to drive said rolls, said belt and glue pot connecting means including idler sprockets carried on axles adjustably mounted on said main frame to permit the glue pot mounting means and the sub-frame to be raised and lowered independently of each other relative the main frame;

fold down bars on each opposite side of said side flap down fold zone to fold down said flaps; and compression rolls, on each opposite side of said compression zone, each mounted to individually and resiliently press the adjacent side flaps against its carton as the carton is advanced through said zone.

* * * * *